US012311278B2

(12) United States Patent
Xiong

(10) Patent No.: US 12,311,278 B2
(45) Date of Patent: May 27, 2025

(54) TOY WATER BALL

(71) Applicant: Shenzhen Huamingjun Rubber Co., Ltd, Shenzhen (CN)

(72) Inventor: Bin Xiong, Guangdong (CN)

(73) Assignee: Shenzhen Huamingjun Rubber Co., Ltd, Shenzhen (CN)

( * ) Notice: Subject to any disclaimer, the term of this patent is extended or adjusted under 35 U.S.C. 154(b) by 0 days.

(21) Appl. No.: 18/665,601

(22) Filed: May 16, 2024

(65) Prior Publication Data

US 2024/0335760 A1 Oct. 10, 2024

Related U.S. Application Data

(63) Continuation of application No. 18/243,099, filed on Sep. 7, 2023, which is a continuation of application No. 18/201,210, filed on May 24, 2023, now Pat. No. 11,786,835.

(30) Foreign Application Priority Data

Apr. 7, 2023 (CN) ..... 202320769008.9

(51) Int. Cl.

| | |
|---|---|
| ***A63H 23/10*** | (2006.01) |
| ***A63H 23/12*** | (2006.01) |
| ***A63H 33/18*** | (2006.01) |

(52) U.S. Cl.

CPC ..... *A63H 23/10* (2013.01); *A63H 23/12* (2013.01); *A63H 33/18* (2013.01); *B65D 2313/04* (2013.01)

(58) Field of Classification Search

CPC ..... A63H 23/10; A63H 23/12; A63H 33/18; B65D 2313/04

See application file for complete search history.

(56) References Cited

U.S. PATENT DOCUMENTS 4,212,460 A * 7/1980 Kraft ..... A63B 65/00 473/577
4,886,273 A * 12/1989 Unger ..... A63F 9/34 273/455
5,065,867 A * 11/1991 Alfredson ..... A45C 11/20 206/542
5,639,076 A * 6/1997 Cmiel ..... H03K 3/0231 446/485
5,975,983 A * 11/1999 Panec ..... A63H 33/30 141/114

(Continued)

*Primary Examiner* — John A Ricci

(57) ABSTRACT

A toy water ball includes at least two shells that are enclosable to form a water storage cavity, each of the shells including: a mounting frame, a magnetic member and a water pocket mounted on the mounting frame. The mounting frame includes a first surface and a second surface oppositely arranged in a thickness direction thereof. When the shells are enclosed to form the water storage cavity, magnetic members of adjacent shells attract each other, and second surfaces of adjacent shells abut each other. The mounting frame is provided with an accommodation groove, a notch of the accommodation groove is located on the first surface, the magnetic member is installed in the accommodation groove, and the water pocket is connected to the first surface, and covers the notch of the accommodation groove on the first surface to seal the magnetic member in the mounting frame.

18 Claims, 11 Drawing Sheets

(56) References Cited

U.S. PATENT DOCUMENTS

| | | | | |
|---|---|---|---|---|
| 7,438,768 | B2 * | 10/2008 | Sakaki | H01F 1/0557 148/303 |
| 8,210,572 | B2 * | 7/2012 | Davis | F16L 37/004 285/9.1 |
| 8,348,061 | B2 * | 1/2013 | Komatsuda | A45D 40/18 206/581 |
| 8,662,298 | B2 * | 3/2014 | Aldana | A45C 11/00 206/320 |
| 11,358,072 | B2 * | 6/2022 | Greenwood | A63H 23/12 |
| 11,786,835 | B1 * | 10/2023 | Xiong | A63H 23/10 446/267 |
| 2008/0258854 | A1 * | 10/2008 | Davis | H01F 7/0263 335/285 |
| 2011/0003655 | A1 * | 1/2011 | Chernick | A63B 39/00 446/491 |
| 2022/0203256 | A1 * | 6/2022 | Chen | A63B 39/08 |

* cited by examiner

TOY WATER BALL

CROSS REFERENCE TO RELATED APPLICATIONS

The present application is a Continuation Application of U.S. application Ser. No. 18/243,099 filed on Sep. 7, 2023, which is a Continuation Application of U.S. application Ser. No. 18/201,210 filed on May 24, 2023, which claims the benefit of Chinese Patent Application No. 202320769008.9 filed on Apr. 7, 2023, the contents of which are incorporated herein by reference in their entirety.

TECHNICAL FIELD

The present application relates to the field of water toys, in particular to a toy water ball.

BACKGROUND

As a summer activity to cool off the heat, water fights are very popular because of their interactive and entertaining features.

Water fights usually use balloons as water carriers. When a balloon filled with water collides with a player, the balloon will burst and the player will be wetted. However, the balloon cannot be reused and is not environmentally friendly, therefore the research and development personnel have developed a toy water ball that can be recycled. This toy water ball includes two shells and each shell includes a mounting frame, a magnetic member installed on the mounting frame and a water pocket. When two mounting frames attract each other by the magnetic members, the two shells will jointly define a cavity for storing water. When the toy water ball hits the player, the two shells will be separated by force, causing the hit player to be wet by water.

The prior art provides installation grooves on the mounting frame and assembles the magnetic members into the installation grooves in order to mount the magnetic members on the mounting frame, which causes the magnetic members to be stressed and come out of the notch of the installation grooves during water fights, causing the toy water ball to fail and the user experience to be poor.

SUMMARY

The technical problem to be solved by the embodiment of the present application is to provide a toy water ball to solve the problem in the prior art that the magnetic member is easy to come out of the notch of the installation groove when the toy water ball is in use, resulting in failure of the toy water ball.

The toy water ball provided by the embodiment of the present application includes: at least two shells that are enclosable to form a water storage cavity, each of the shells including: a mounting frame, a magnetic member and a water pocket, the mounting frame comprising a first surface and a second surface oppositely arranged in a thickness direction thereof, the mounting frame being provided with an accommodation groove, a notch of the accommodation groove being located on the first surface, the magnetic member being installed in the accommodation groove, and the water pocket being connected to the first surface, and covering the notch of the accommodation groove on the first surface to seal the magnetic member in the mounting frame; wherein when the shells are enclosed to form the water storage cavity, magnetic members at corresponding positions on mounting frames of adjacent shells attract each other, so that second surfaces of adjacent mounting frames abut each other.

Furthermore, both the mounting frame and the water pocket are made of flexible materials.

Furthermore, the mounting frame is further provided with a gap groove, the gap groove is arranged on a periphery of the magnetic member and a notch of the gap groove is located on the first surface, a surrounding edge is formed between the accommodation groove and the gap groove to surround the magnetic member, and the water pocket is provided with an embedded part embedded in the gap groove.

Furthermore, the gap groove is located at a position close to an end of the magnetic member, and two ends of the gap groove extend from a direction parallel to the end of the magnetic member and to turn to a direction of a side surface of the magnetic member.

Furthermore, the mounting frame further includes a limiting baffle, and the limiting baffle is arranged at the notch of the accommodation groove, and is opposite to a groove bottom of the accommodation groove.

Furthermore, in a length direction of the accommodation groove, the limiting baffle is arranged at a middle position of the notch of the accommodation groove, so that a middle position of the magnetic member is covered by the limiting baffle, and two ends of the magnetic member are exposed from the notch of the accommodation groove.

Furthermore, the gap groove includes a first groove wall located on one side of the surrounding edge and a second groove wall opposite to the first groove wall, the mounting frame is further provided with a connection rib, and the connection rib connects the first groove wall and the second groove wall.

Furthermore, four corner positions of the magnetic member are all provided with gap grooves, and each gap groove is "L" shaped.

Furthermore, an inner ring of the mounting frame is provided with a warped edge at a position close to the second surface, and the warped edge extends towards a direction close to a center of the mounting frame and away from the first surface, and an angle between the warped edge and a plane where the second surface is located is ≥5 degrees, when the second surfaces of the adjacent mounting frames abut each other, corresponding warped edges of the adjacent mounting frames fit each other under pressure.

Furthermore, the toy water ball further includes a light-emitting assembly, wherein the light-emitting assembly is arranged inside the shells, and the light-emitting assembly comprises a lamp bead, a controller, a vibration sensor, and a battery for powering the lamp bead, the controller and the vibration sensor; the controller controls the lamp bead to work when the vibration sensor detects vibration.

Furthermore, an edge of the magnetic member is provided with a round chamfer.

Furthermore, an adhesive layer is provided between the magnetic member and the accommodation groove.

Furthermore, when the water pocket is connected to the first surface, a covering layer is formed on the first surface, and a thickness of the covering layer is ≥0.3 mm, a thickness from a bottom of the accommodation groove to the second surface is ≥0.3 mm, and a thickness of the mounting frame is ≥2 mm.

Compared with the prior art, the beneficial effect of the toy water ball provided by the embodiment of the present application is that the toy water ball provided by the embodiment of the present application includes at least two shells that are enclosable to form a water storage cavity. Each of the shells includes a mounting frame, a magnetic member and a water pocket mounted on the mounting frame. The mounting frame includes a first surface and a second surface oppositely arranged in a thickness direction thereof. When the shells are enclosed to define the water storage cavity, the magnetic members of adjacent shells attract each other, and the second surfaces of adjacent shells abut each other. Specially, the mounting frame is provided with an accommodation groove, a notch of the accommodation groove is located on the first surface, the magnetic member is installed in the accommodation groove, and the water pocket is connected to the first surface, and covers the notch of the accommodation groove on the first surface to seal the magnetic member in the mounting frame. Therefore, when the toy water ball provided by the embodiment is in use, the magnetic member will no longer be easy to come out of the installation groove under force as in the prior art, and the magnetic member will not get wet and rust. It can be seen that the toy water ball provided by the embodiment will not easily fail and has a long service life.

BRIEF DESCRIPTION OF THE DRAWINGS

The specific embodiment of the present application will be described in further detail below in conjunction with accompanying drawing and embodiment, in the accompanying drawing.

The reference numerals in the drawings are.

Figure 1:
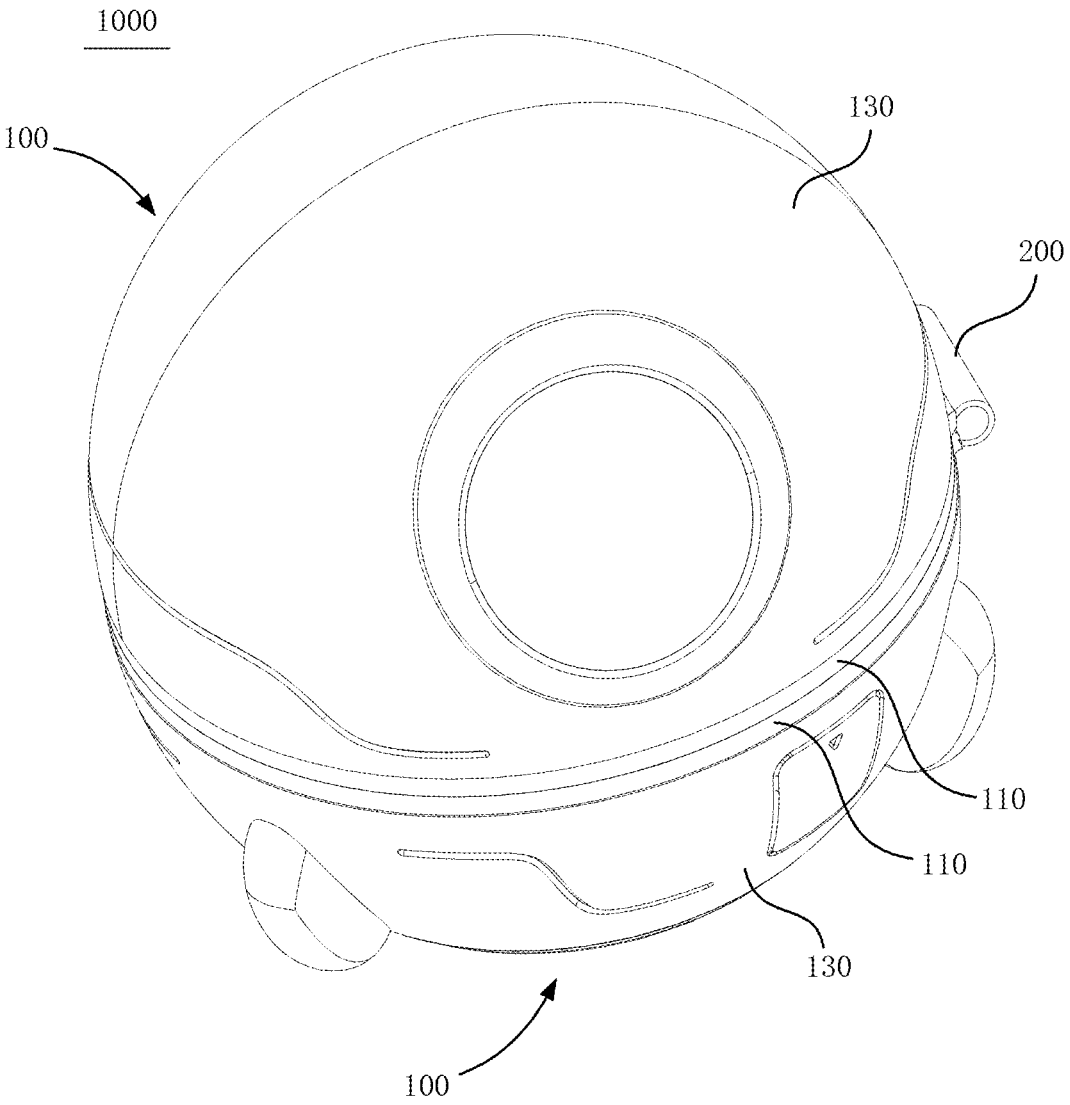
FIG. 1 is a schematic diagram of the three-dimensional structure of the toy water ball provided by an embodiment of the present application.

1000. Toy water ball;

100, Shell; 110, Mounting frame; 111, First surface; 112, Second surface; 113, Accommodation groove; 114, Gap groove; 1141, First groove wall; 1142, Second groove wall; 1143, Groove bottom; 115, surrounding edge; 116, limiting baffle; 117, connection rib; 118, Warped edge; 120, Magnetic member; 121, Round chamfer; 130, Water pocket; 131, Embedded part;

200. Connection structure.

DETAILED DESCRIPTION

It should be noted that, in the case of no conflict, the embodiments in the present application and the features in the embodiments can be combined with each other. Now with reference to the accompanying drawings, the preferred embodiments of the present application are described in detail.

The embodiments of the present application provide a toy water ball 1000, as shown in FIG. 1 to FIG. 5, the toy water ball 1000 includes at least two shells 100 that are enclosable to form a water storage cavity. Each shell 100 includes a mounting frame 110, a magnetic member 120 and a water pocket 130. The mounting frame 110 includes a first surface 111 and a second surface 112 oppositely arranged in its thickness direction (X direction in FIG. 3). A notch of the accommodation groove 113 is located on the first surface 111, the magnetic member 120 is installed in the accommodation groove 113, and the water pocket 130 is connected to the first surface 111, and covers the notch of the accommodation groove 113 on the first surface 111 to seal the magnetic member 120 in the mounting frame 110.

The shells 100 in this embodiment can enclose to define a water storage cavity. At this time, the magnetic members 120 of adjacent shells 100 attract each other, so that the second surfaces 112 of adjacent shells 100 abut each other, thereby avoiding the overflow of water in the water storage cavity. When the toy water ball 1000 of the embodiments is thrown at the player, the toy water ball 1000 will be impacted by an external force, so that the water in the water storage cavity will overflow, causing the player hit by the toy water ball 1000 to be wet. Of course, it can be understood that hitting the player is only a reference method for playing the water ball. In addition to hitting the player, it is also possible to simply hit the toy water ball 1000 to the ground, wall or other places. This embodiment does not make a limitation here.

Specifically, since in this embodiment, the accommodation groove 113 for installing the magnetic member 120 is opened on the first surface 111, and the water pocket 130 is connected to the first surface 111, which makes the water pocket 130 seal the magnetic member 120 by cooperating with the mounting frame 110. This not only makes the magnetic member 120 not easy to come out of the accommodation groove 113 under force as in the prior art when the toy water ball 1000 is in use, but also prevents the magnetic member 120 from getting wet. It should be noted that the magnetic member 120 is prone to rust after being wetted by water, which makes the toy water ball 1000 unsuitable for continued use. It can be seen that, by implementing this embodiment, the service life of the toy water ball 1000 can be effectively extended, and the toy water ball 1000 will not easily fail.

Figure 7:
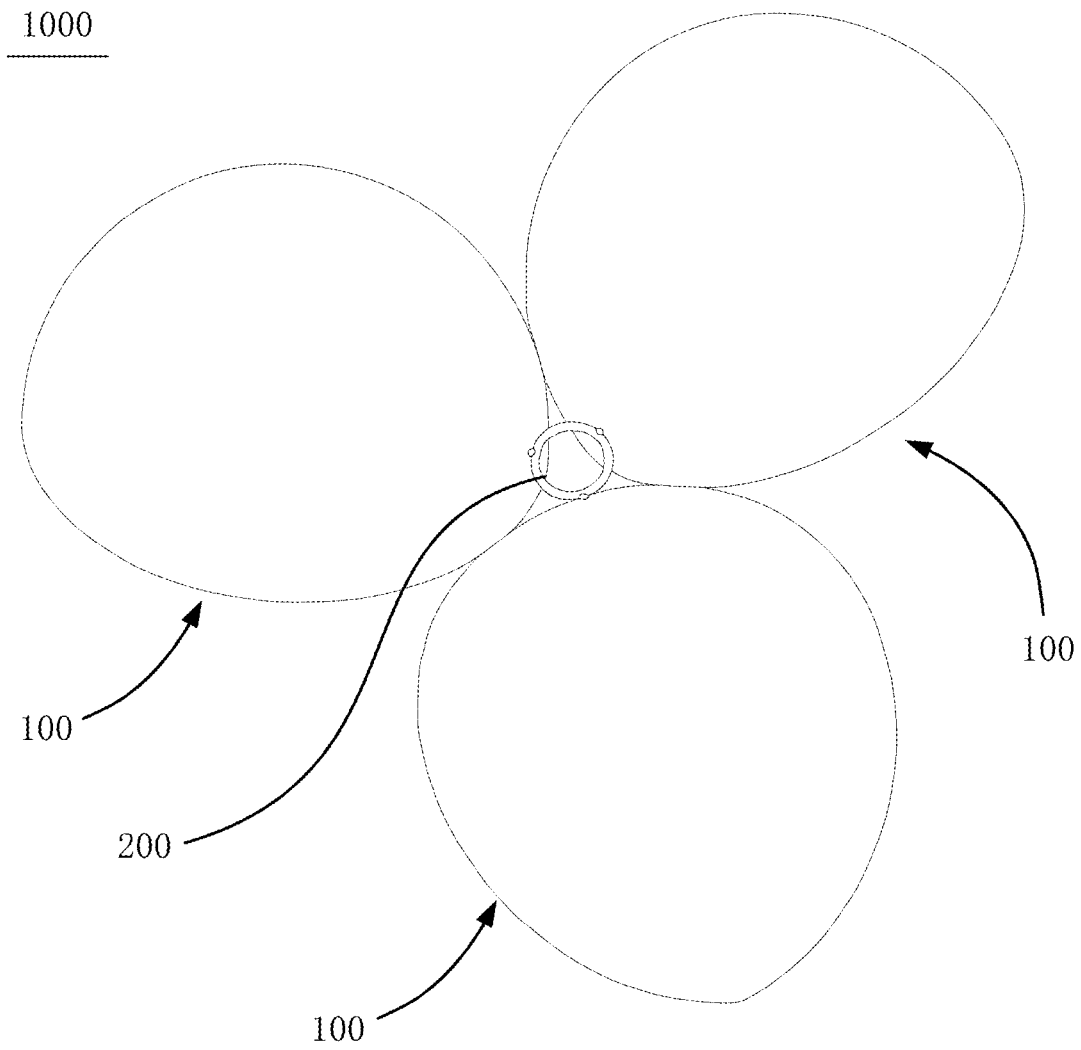
FIG. 7 is a schematic diagram of the three-dimensional structure of the toy water ball provided by another embodiment of the present application, when the shells are separated.

It is worth mentioning that since two shells 100 can be provided as in FIG. 1, three can be provided as in FIG. 7, four or five can be provided, and this embodiment does not make a limitation here.

Referring to FIG. 1, in a specific embodiment, both the mounting frame 110 and the water pocket 130 are made of flexible materials.

In the first aspect, the implementation of this embodiment can prevent the toy water ball 1000 from hurting or injuring the player, and eliminate potential safety hazards.

In the second aspect, the water pocket 130 of this embodiment can change the volume of the toy water ball 1000 through deformation, so as to achieve the technical effect of saving storage space, so as to facilitate storage by users.

In the third aspect, the implementation of this embodiment can reduce the probability of damage when the mounting frame 110 and the water pocket 130 are impacted, which is beneficial to improve the service life of the toy water ball 1000.

Referring to FIG. 1, in a specific embodiment, the mounting frame 110 and the water pocket 130 are made of silicone or rubber.

In order to improve the structural strength of the toy water ball 1000 and further avoid failure of the toy water ball 1000, the present application provides the following two embodiments for reference.

Referring to FIG. 3-FIG. 6 and FIG. 9, in the first embodiment, the mounting frame 110 is also provided with a gap groove 114, the gap groove 114 is arranged on the periphery of the magnetic member 120 and the notch of the gap groove 114 is located on the first surface 111, A surrounding edge 115 surrounding the magnetic member 120 is formed between the accommodation groove 113 and the gap groove 114, and the water pocket 130 is provided with an embedded portion 131 embedded in the gap groove 114.

Specifically, when the user uses the toy water ball 1000, it is inevitable that the water pocket 130 will be pulled, because when the magnetic members 120 of the adjacent shells 100 attract each other, the magnetic members 120 will apply force to limit that the adjacent shells 100 are pulled apart. Therefore, when the water pocket 130 is pulled, the position of the water pocket 130 adjacent to the magnetic member 120 will be subjected to a relatively large force, and it is easy to break away from the connection relationship with the mounting frame 110. In order to solve this technical problem, the water pocket 130 of this embodiment is partially embedded in the gap groove 114 between the groove wall of the accommodation groove 113 and the surrounding edge 115, so that the connection relationship of the position where the water pocket 130 is subjected to a relatively large force with the mounting frame 110 will be closer. It can be seen that, by implementing this embodiment, the structural strength of the toy water ball 1000 can be improved so that it will not be easily damaged.

When the toy water ball 1000 of this embodiment is produced, a slot will be opened on the mold for making the mounting frame 110, and the magnetic member 120 will be installed in this slot, and then the materials used to manufacture the mounting frame 110 will be pressed onto the mold so as to manufacture the mounting frame 110 equipped with the magnetic members 120, and finally process the water pocket 130 onto the mounting frame 110. Specifically, as long as the outline of the slot is set larger than the magnetic member 120, the manufactured mounting frame 110 will be formed with the above-mentioned gap groove 114 and surrounding edge 115.

Specifically, there are many shapes of the surrounding edge 115, which may be circular, oval, square, etc., so this embodiment does not limit it here.

Figure 11:
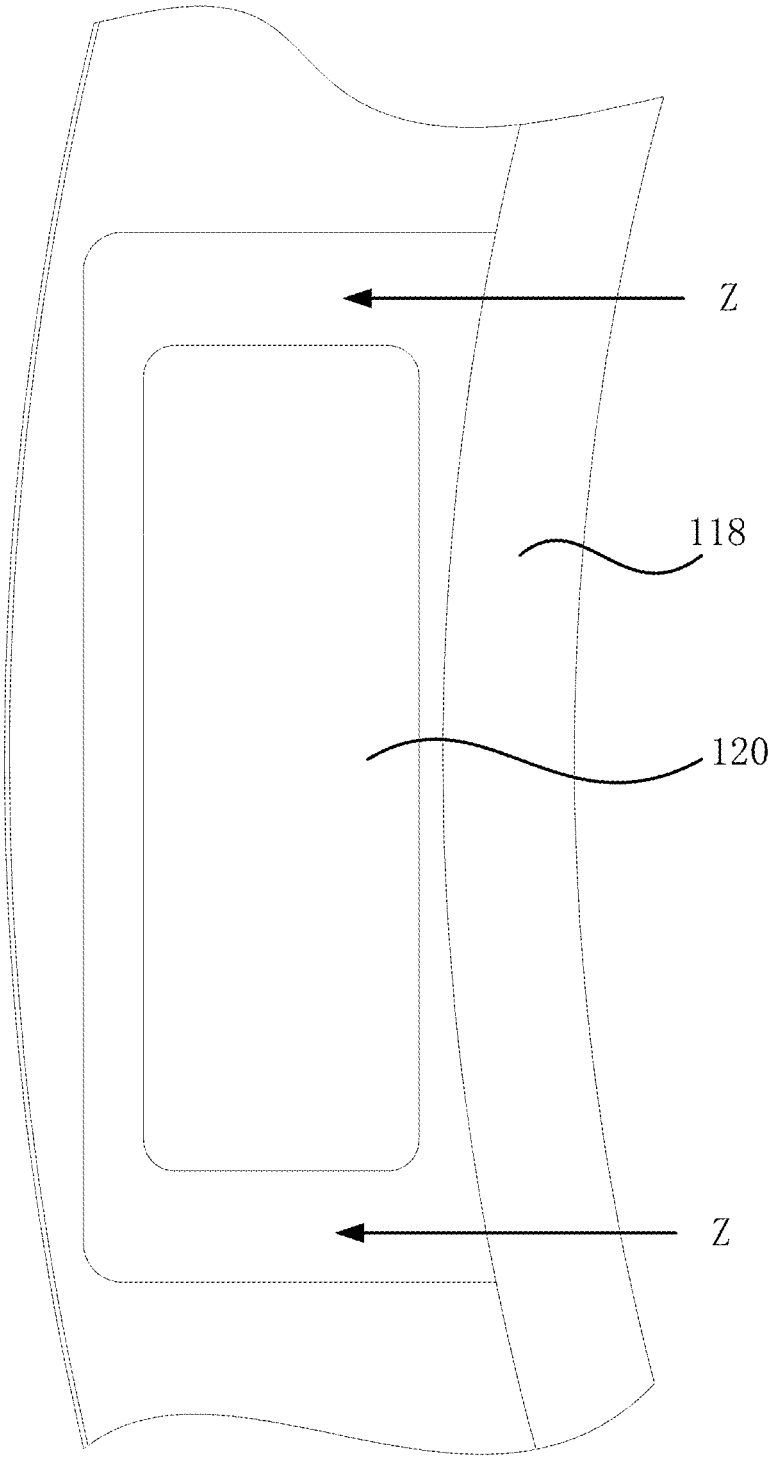
FIG. 11 is a schematic diagram of a partial structure of the mounting frame provided by another embodiment of the present application.

Referring to FIG. 11, in the second embodiment, the outline of the magnetic member 120 is smaller than the outline of the accommodation groove 113, so that there is a gap between the magnetic member 120 and the groove wall of the accommodation groove 113 (position Z in FIG. 11), and the water pocket 130 is partially embedded in the gap.

Specifically, when the user uses the toy water ball 1000, it is inevitable to pull the water pocket 130. When the magnetic members 120 of adjacent shells 100 attract each other, the magnetic members 120 will apply force to limit the adjacent shells 100 from being pulled apart, so when the water pocket 130 is pulled, the force of the position of the water pocket 130 adjacent to the magnetic member 120 will be relatively large, and it is easy to break away from the connection relationship with the mounting frame 110. In order to solve this technical problem, the water pocket 130 of this embodiment is partially embedded in the gap between the magnetic member 120 and the groove wall of the accommodation groove 113, so that the connection relationship between the position of the water pocket 130 where the force is greater and the mounting frame 110 will be closer. It can be seen that, by implementing this embodiment, the structural strength of the toy water ball 1000 can be improved so that it will not be easily damaged.

When making the toy water ball 1000 of this embodiment, a mounting frame 110 with a accommodation groove 113 is processed first, then the magnetic member 120 is placed in the groove, and finally the water pocket 130 is processed onto the mounting frame 110.

Figure 4:
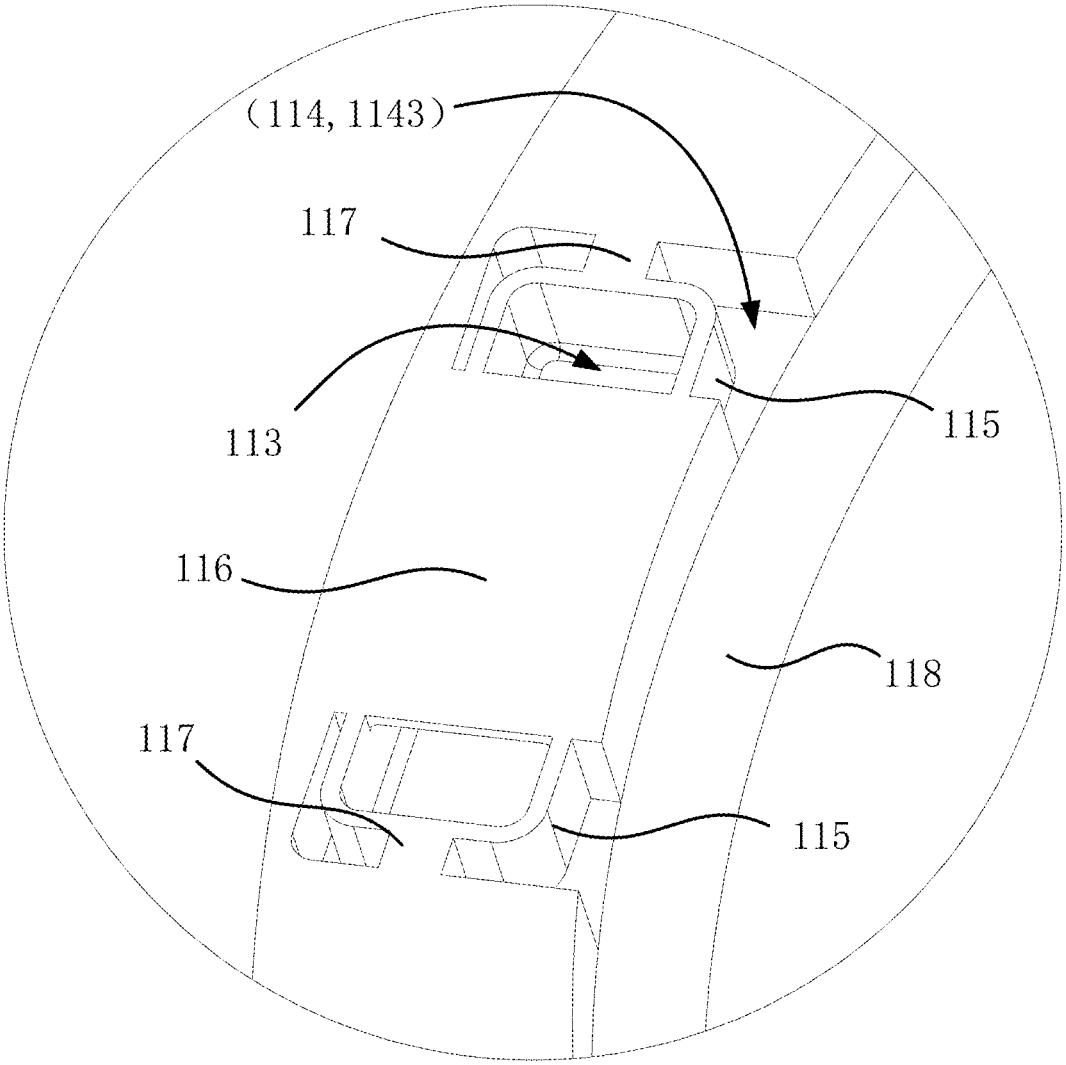
FIG. 4 is a partially enlarged schematic diagram of position A in FIG. 3.

Referring to FIG. 4, in a specific embodiment, the surrounding edge 115 is arranged around the magnetic member 120, that is, the surrounding edge 115 wraps the outer peripheral surface of the magnetic member 120, so that not only the constraint of the mounting frame 110 on the magnetic member 120 can be strengthened, making the connection between the magnetic member 120 and the mounting frame 110 closer, but also it is convenient for processing.

Specifically, if the magnetic member 120 cannot move in the slot when the magnetic member 120 is installed in the slot of the mold, then when the material for manufacturing the mounting frame 110 is pressed onto the mold, the magnetic member 120 may be stressed to come out of the slot, which will cause defective products if it is light, or damage the mold if it is serious. The surrounding edge 115 is arranged around the magnetic member 120, which means that the magnetic member 120 can move in the slot. When the magnetic member 120 is stressed, it will move in the slot and will not easily come out of the slot, which can not only improve the yield rate, but also does not damage the mold.

Figure 9:
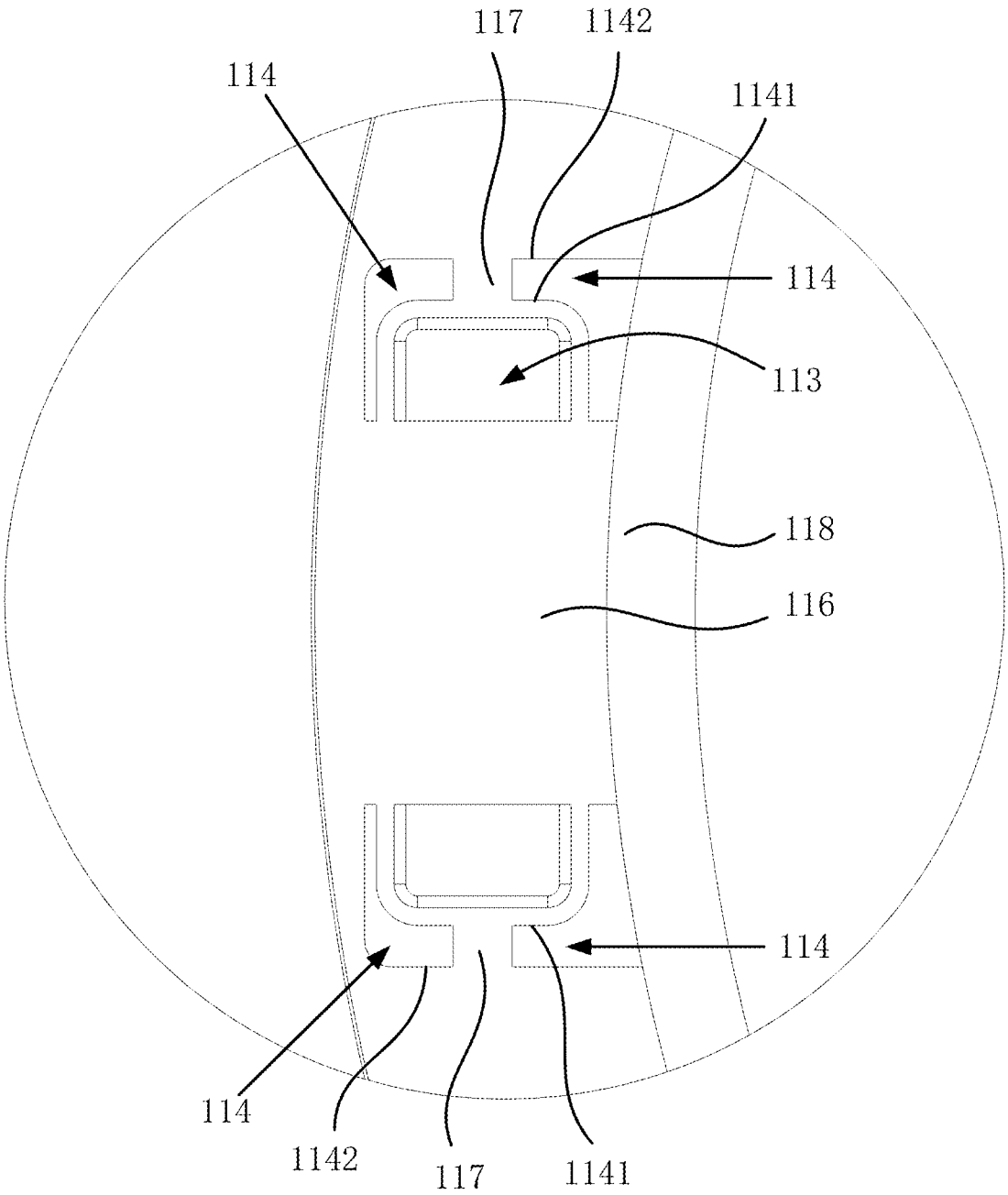
FIG. 9 is a partially enlarged schematic diagram of position B in FIG. 8.

Referring to FIG. 9, in one embodiment, the gap groove 114 is disposed close to the end of the magnetic member 120, and both ends of the gap groove 114 extend from the direction parallel to the end of the magnetic member 120 and to turn to the direction of the side surface of the magnetic member 120. In this way, the connection relationship between the embedded portion 131 and the mounting frame 110 will be closer. The structural strength of the toy water ball 1000 can be further improved so that it will not be easily damaged.

Referring to FIG. 4, in a specific embodiment, the mounting frame 110 also includes a limiting baffle 116, the limiting baffle 116 is arranged at the notch of the accommodation groove 113, and is opposite to the groove bottom of the accommodation groove 113.

Specifically, the limiting baffle 116 can cooperate with the surrounding edge 115 to firmly limit the magnetic member 120 in the accommodation groove.

Referring to FIG. 4, in order to improve the limiting effect of the limiting baffle 116 on the magnetic member 120, in a specific embodiment, in the length direction of the accommodation groove 113, the limiting baffle 116 is set in the middle position of the notch of the accommodation groove 113, so that the middle position of the magnetic member 120 is covered by the limiting baffle 116, and the two ends of the magnetic member 120 are exposed from the notch.

Referring to FIG. 9, in a specific embodiment, the gap groove 114 includes a first groove wall 1141 on one side of the surrounding edge 115, and a second groove wall 1142 opposite to the first groove wall 1141, and the mounting frame 110 is also provided with connection ribs 117, the connection ribs 117 connect the first groove wall 1141 and the second groove wall 1142.

Specifically, when the user uses the toy water ball 1000, it is inevitable that the water pocket 130 will be pulled, because when the magnetic members 120 of the adjacent shells 100 attract each other, the magnetic members 120 will apply force to limit that the adjacent shells 100 are pulled apart. Therefore, when the water pocket 130 is pulled, the part of the mounting frame 110 near the magnetic member 120 will be subjected to a relatively large force, which will cause a large deformation of this part and be easily damaged. In order to solve this technical problem, the mounting frame 110 of this embodiment is provided with a connection rib 117, the connection rib 117 connects the first groove wall 1141 and the second groove wall 1142 of the gap groove 114, and the connection rib 117 can be used to apply a reaction force when the user pulls the water pocket 130, thereby reducing the degree of deformation of the part of the mounting frame 110 near the magnetic member 120. It can be seen that, by implementing this embodiment, the structural strength of the toy water ball 1000 can be improved, making the toy water ball 1000 durable.

In addition, when the water pocket 130 is processed on the mounting frame 110, the mounting frame 110 may be deformed accordingly. Exemplarily, when the water pocket 130 is processed on the mounting frame 110, when the raw material enters the gap groove 114, it will exert a force in the opposite direction on the first groove wall 1141 and the second groove wall 1142. If the force is too large, the distance between the first groove wall 1141 and the second groove wall 1142 will be changed by this force, thus causing the mounting frame 110 to deform, and if the deformation is too large, it will become a defective product, while the connection rib 117 of this embodiment can strengthen the constraint between the first groove wall 1141 and the second groove wall 1142 to avoid excessive deformation of the mounting frame 110 when the water pocket 130 is processed on the mounting frame 110, thereby improving the yield rate.

In a specific embodiment, the connection ribs 117 are also connected to the groove bottom 1143 of the gap groove 114, so that the connection ribs 117 will be less deformed when stressed, which can further improve the structural strength of the toy water ball 1000 and make the toy water ball 1000 durable.

Figure 10:
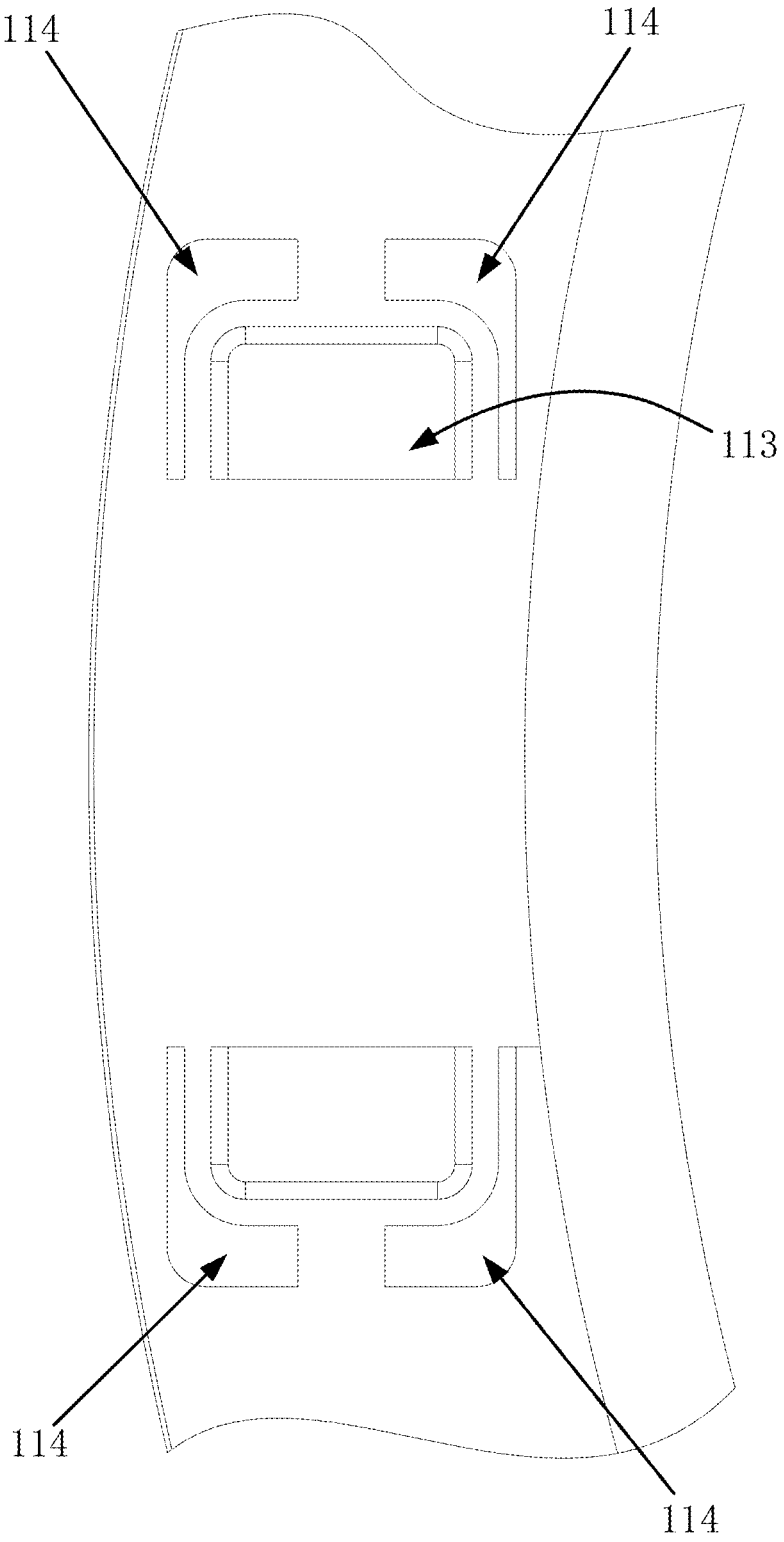
FIG. 10 is a schematic diagram of a partial structural of the mounting frame provided by another embodiment of the present application.

Referring to FIG. 10, in a specific embodiment, gap grooves 114 are provided at four corner positions of the magnetic member 120, and the gap grooves 114 are "L" shaped. In this way, the mounting frame 110 will include a plurality of connection ribs 117, and the plurality of connection ribs 117 are respectively located in different directions of the magnetic member 120, which can further prevent the mounting frame 110 from being excessively deformed when the water pocket 130 is processed on the mounting frame 110, thereby improving the yield rate.

Figure 8:
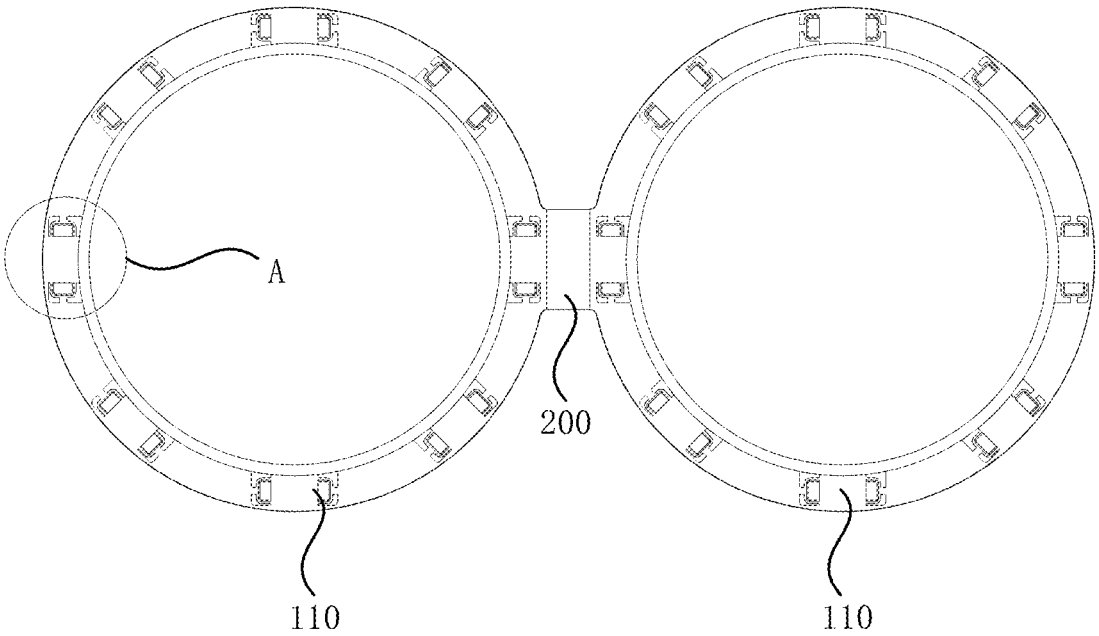
FIG. 8 is a schematic diagram of the plane structure of the mounting frame and the connection structure provided by an embodiment of the present application.

Referring to FIGS. 7-8, in an embodiment, the toy water ball 1000 further includes a connection structure 200, and each shell 100 is connected to the connection structure 200.

Specifically, it is conceivable that if there is no connection relationship between the shells 100 and they are scattered and out of order, it will be very cumbersome and time-consuming to assemble the shells 100 into a toy water ball 1000, and some shells are easy to get lost during the game. The connection structure 200 can connect the shells 100 together and simplify the assembly time of the toy water ball 1000.

Figure 2:
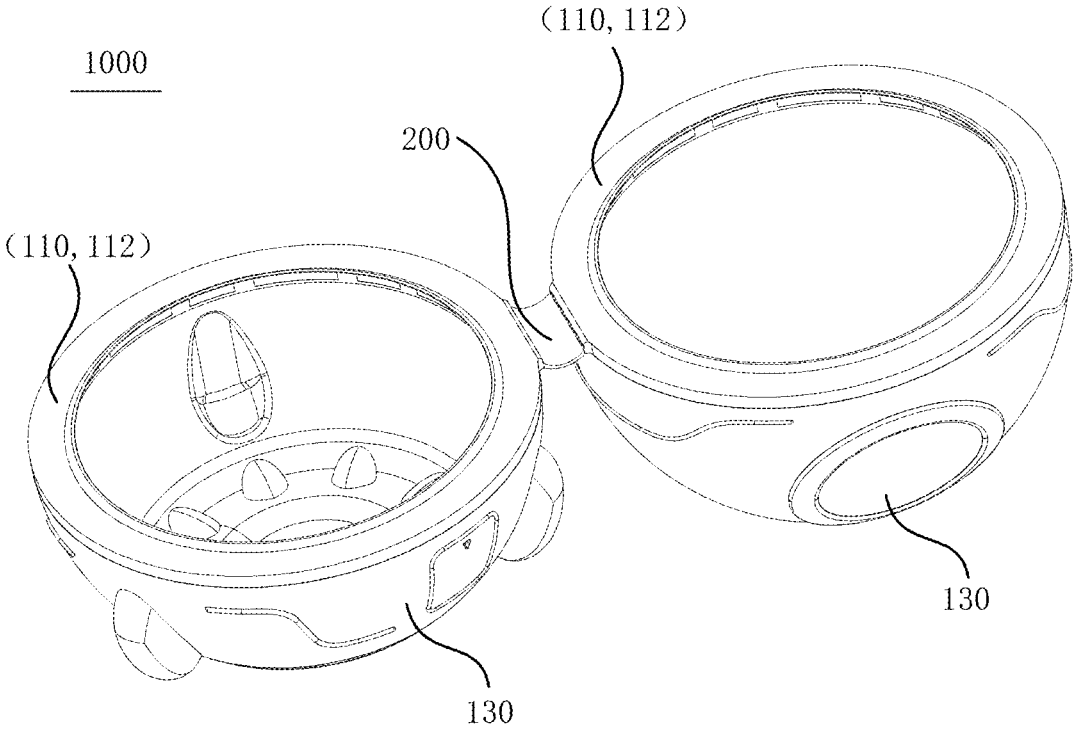
FIG. 2 is a schematic diagram of the three-dimensional structure of the toy water ball provided by an embodiment of the present application, when the shells are separated.
Figure 3:
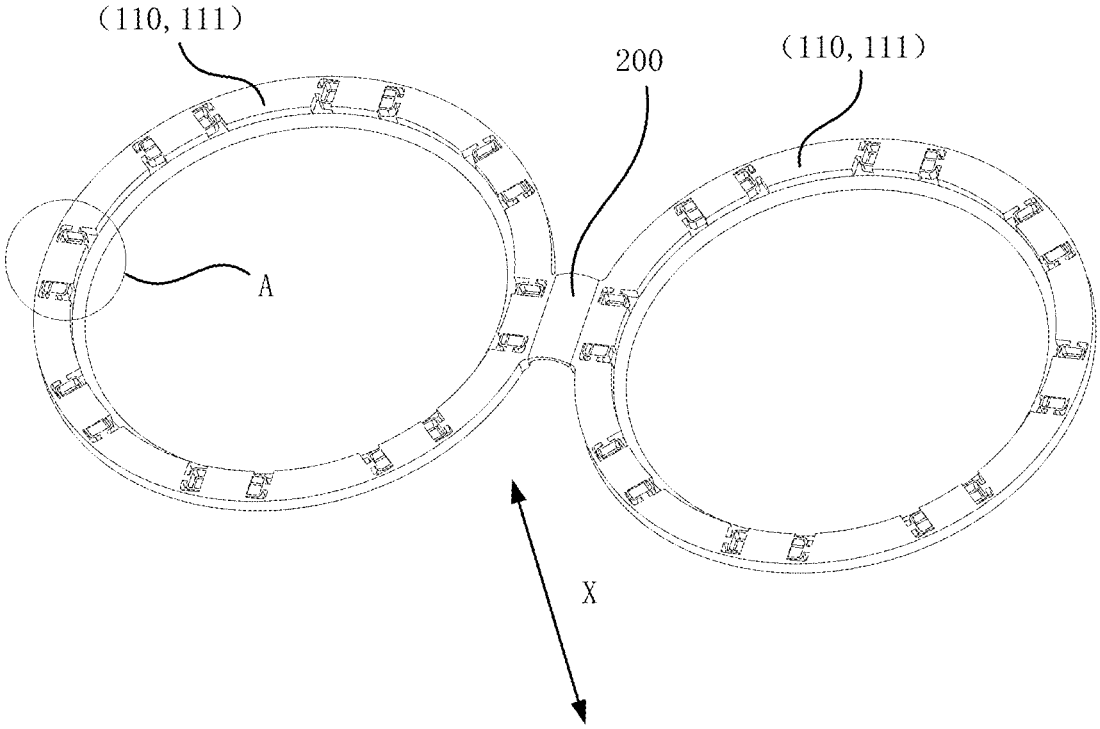
FIG. 3 is a schematic diagram of the three-dimensional structure of the mounting frame and the connection structure provided by an embodiment of the present application.

Referring to FIGS. 1-3, in a specific embodiment, the connection structure 200 is made of flexible material, and the connection structure 200 is integrally formed with the mounting frame 110.

Specifically, the connection structure 200 made of flexible material can prevent the toy water ball 1000 from hurting or injuring the player, and the integral formation of the connection structure 200 and the mounting frame 110 can simplify the assembly steps.

Referring to FIGS. 1-3, the connection structure 200 and the mounting frame 110 in FIGS. 1-3 are both made of silica gel. Specifically, the raw material is pressed into a corresponding mold and formed integrally to form the connection structure 200 and the mounting frame 110. The toy water ball 1000 is very convenient to use, as long as one of the shells 100 is moved toward another shell 100, the water storage cavity can be enclosed and defined.

Of course, it can be understood that the connection structure 200 can also be a component independent of the mounting frame 110, just like the toy water ball 1000 shown in the drawings.

Referring to FIG. 4 and FIG. 9, in one embodiment, the inner circle of the mounting frame 110 is provided with a warped edge 118 at a position close to the second surface 112, and the warped edge 118 extends toward a direction close to the center of the mounting frame 110 and away from the first surface 111, and the included angle between the warped edge 118 and the plane where the second surface 112 is located is ≥5 degrees, when the second surfaces 112 of the adjacent mounting frames 110 abut each other, the corresponding warped edges 118 on the adjacent mounting frames 110 fit each other under pressure.

Specifically, because the warped edge 118 extends toward a direction close to the center of the mounting frame 110 and away from the first surface 111, the warped edge 118 of the shells 100 have already contacted each other before the second surfaces 112 of the shells 100 abut each other. When the second surfaces 112 of the shells 100 abut each other, the warped edges 118 of the shells 100 have been pressed against each other and elastically deformed, so setting the warped edges 118 can better limit the overflow of the water in the water storage cavity to avoid water leakage from the toy water ball 1000.

In one embodiment, the toy water ball further includes a light-emitting assembly, which is arranged inside the shells, and the light-emitting assembly includes a lamp bead, a controller, a vibration sensor, and a battery for powering the light bead, the controller and the vibration sensor. The controller controls the lamp bead to work when the vibration sensor detects vibration.

Specifically, when the toy water ball hits a human body or an object, it will trigger a vibration sensor, and the vibration sensor will feed it back to the controller, and the controller will control the lamp bead to work when it receives the feedback information from the vibration sensor. By implementing this embodiment, the aesthetics of the toy water ball can be increased, especially in the evening and night, the luminous toy water ball will look very beautiful.

Figure 5:
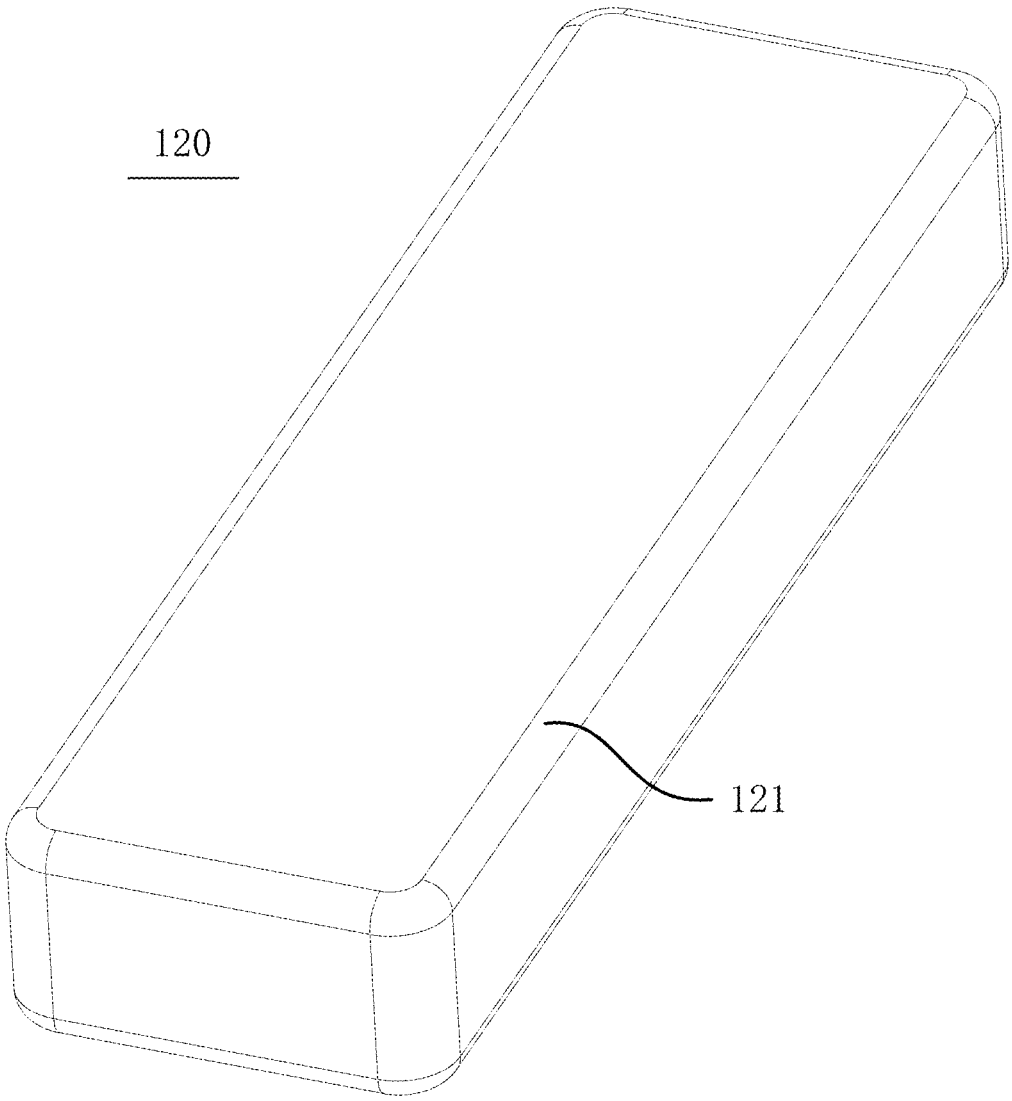
FIG. 5 is a schematic diagram of the three-dimensional structure of the magnetic member provided by an embodiment of the present application.
Figure 6:
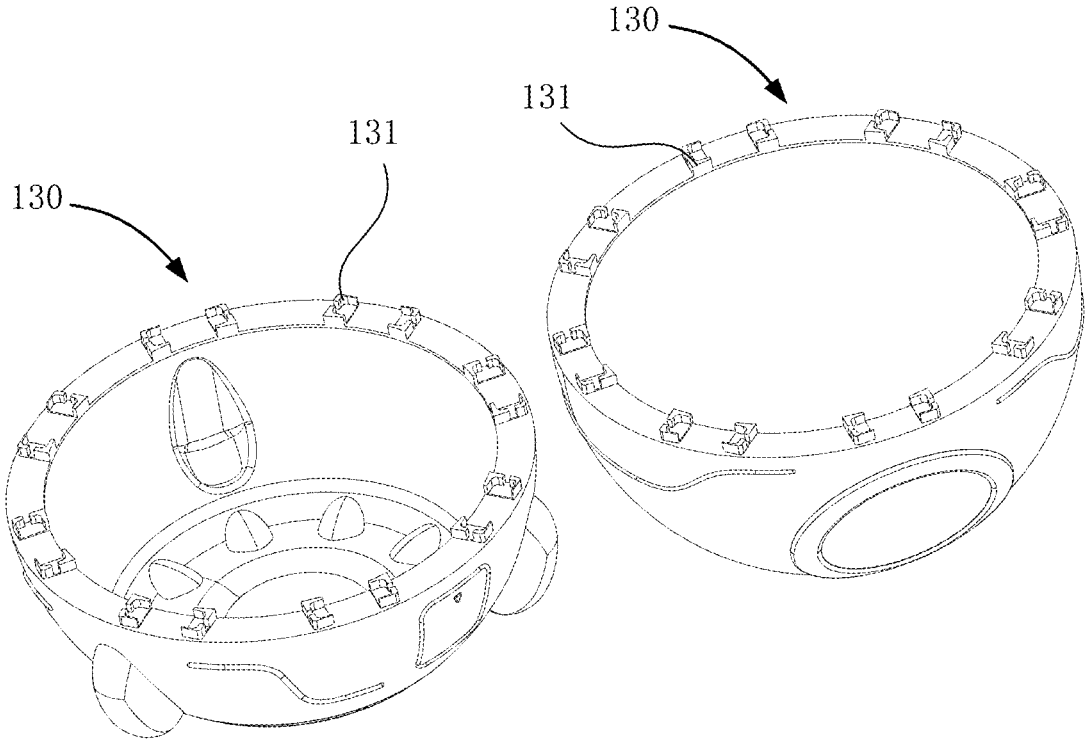
FIG. 6 is a schematic diagram of the toy water ball shown in FIG. 2, omitting the mounting frame and the connection structure.

Referring to FIG. 5, in an embodiment, the edge of the magnetic member 120 is provided with a round chamfer 121.

Specifically, when the user uses the toy water ball 1000, it is inevitable that the water pocket 130 will be pulled. Since the magnetic members 120 of the shells 100 attract each other, when the user pulls the water pocket 130, the magnetic member 120 will exert a reverse force on the mounting frame 110 to deform the groove bottom 1143 of the accommodation groove 113. If the edge of the magnetic member 120 is relatively sharp, the groove bottom 1143 of the accommodation groove 113 is easily scratched by the magnetic member 120 at this time, causing the toy water ball 1000 to fail. Therefore, in this embodiment, the edge of the magnetic member 120 is provided with the round chamfer 121 to prevent the magnetic member 120 from scratching the groove bottom 1143 of the accommodation groove 113.

Figure 12:
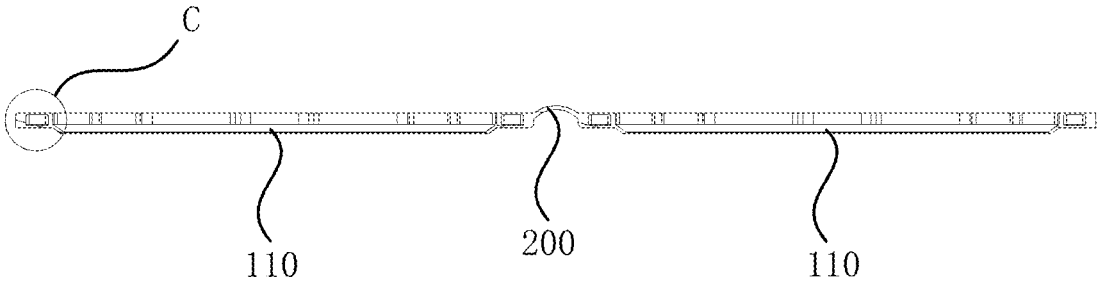
FIG. 12 is a cross-sectional view of the mounting frame and the connection structure provided by an embodiment of the present invention.
Figure 13:
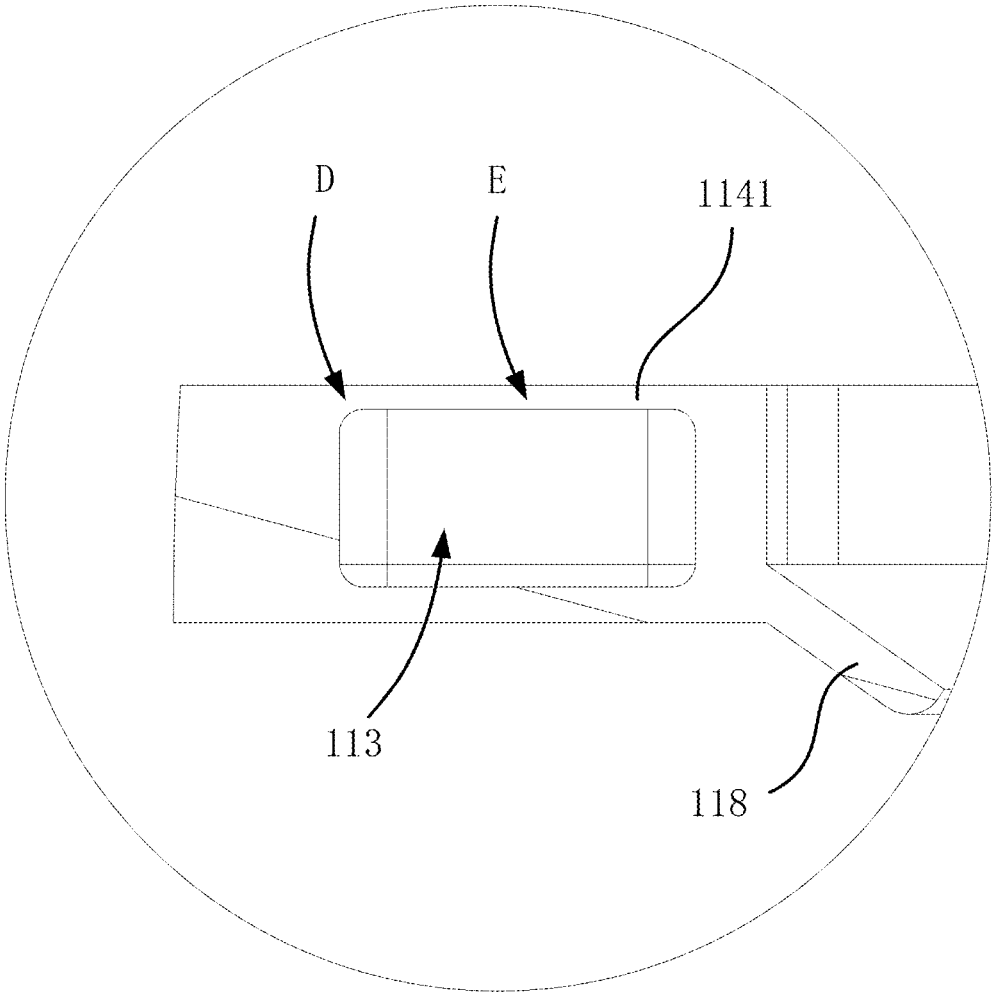
FIG. 13 is a partially enlarged schematic diagram of position C in FIG. 12.

In addition, the round chamfer 121 on the edge of the magnetic member 120 can also make the connection position between the limiting baffle 116 and the surrounding edge 115 thicker. Referring to FIG. 12 and FIG. 13, the position D in FIG. 13 is thicker than the position E, In this way, the structural strength of the limiting baffle 116 will be relatively large, and it will not be damaged so easily.

In one embodiment, an adhesive layer is disposed between the magnetic member 120 and the accommodation groove 113. In this way, the displacement of the magnetic member 120 can be avoided when the water pocket 130 is processed on the mounting frame 110.

In one embodiment, when the water pocket 130 is connected to the first surface 111, a covering layer is formed on the first surface 111, the thickness of the covering layer is ≥0.3 mm, and the thickness from the bottom of the accommodation groove 113 to the second surface 112 is ≥0.3 mm. The thickness of the mounting frame 110 is greater than or equal to 2 mm, so that the structural strength of the shells 100 will be better, making the toy water ball 1000 durable.

It should be understood that the above embodiments are only used to illustrate the technical solutions of the present application, rather than to limit them. For those skilled in the art, the technical solutions described in the above embodiments can be modified, or intermediate parts thereof can be modified. Technical features are replaced by equivalents; and all these modifications and replacements should belong to the scope of protection of the appended claims of the present application.

What is claimed is:

1. A toy water ball, comprising:

at least two shells that are enclosable to form a water storage cavity, each of the shells comprising:

a mounting frame, a magnetic member and a water pocket, the water pocket being connected to the mounting frame, the magnetic member seal in the mounting frame;

wherein when the shells are enclosed to form the water storage cavity, magnetic members at corresponding positions on mounting frames of adjacent shells attract each other, so that adjacent mounting frames abut each other;

the toy water ball includes a connection structure, and each shell is connected to the connection structure; and the connection structure is made of flexible material, and the connection structure is integrally formed with the mounting frame.

2. The toy water ball according to claim 1, wherein the mounting frame is provided with an accommodating groove for accommodating the magnetic member, and the accommodating groove has a notch and a groove bottom; the mounting frame further includes a limiting baffle, and the limiting baffle is arranged at the notch of the accommodation groove, and is opposite to a groove bottom of the accommodation groove.

3. The toy water ball according to claim 2, wherein edge of the magnetic member is provided with a round chamfer.

4. The toy water ball according to claim 2, wherein an adhesive layer is provided between the magnetic member and the accommodation groove.

5. The toy water ball according to claim 2, wherein when the water pocket is connected to the mounting frame, a covering layer is formed on mounting frame, and total thickness of the covering layer, and the mounting frame is ≥2.3 mm.

6. The toy water ball according to claim 2, wherein in a length direction of the accommodation groove, the limiting baffle is arranged at a middle position of the notch of the accommodation groove, so that a middle position of the magnetic member is covered by the limiting baffle, and two ends of the magnetic member are exposed from the notch of the accommodation groove.

7. The toy water ball according to claim 6, wherein an adhesive layer is provided between the magnetic member and the accommodation groove.

8. The toy water ball according to claim 1, wherein an inner ring of the mounting frame is provided with a warped edge when the adjacent mounting frames abut each other, corresponding warped edges of the adjacent mounting frames fit each other under pressure.

9. The toy water ball according to claim 1, further comprising a light-emitting assembly, wherein the light-emitting assembly is arranged inside the shells, and the light-emitting assembly comprises a lamp bead, a controller, a vibration sensor, and a battery for powering the lamp bead, the controller and the vibration sensor; the controller controls the lamp bead to work when the vibration sensor detects vibration.

10. The toy water ball according to claim 1, wherein an edge of the magnetic member is provided with a round chamfer.

11. The toy water ball according to claim 1, wherein when the water pocket is connected to the mounting frame, a covering layer is formed on the mounting frame, and total thickness of the covering layer and the mounting frame is ≥2.3 mm.

12. The toy water ball according to claim 1, wherein both the mounting frame and the water pocket are made of flexible materials.

13. The toy water ball according to claim 12, wherein the mounting frame is further provided with a gap groove, the gap groove is arranged on a periphery of the magnetic member, and the water pocket is provided with an embedded part embedded in the gap groove.

14. The toy water ball according to claim 13, wherein the gap groove is located at a position close to an end of the magnetic member, and two ends of the gap groove extend from a direction parallel to the end of the magnetic member and to turn to a direction of a side surface of the magnetic member.

15. The toy water ball according to claim 13, wherein the gap groove comprises a first groove wall and a second groove wall opposite to the first groove wall, the mounting frame is further provided with a connection rib, and the connection rib connects the first groove wall and the second groove wall.

16. The toy water ball according to claim 13, wherein four corner positions of the magnetic member are all provided with gap grooves, and each gap groove is "L" shaped.

17. The toy water ball according to claim 13, wherein an edge of the magnetic member is provided with a round chamfer.

18. The toy water ball according to claim 13, wherein when the water pocket is connected to the mounting frame, a covering layer is formed on mounting frame, and total thickness of the covering layer, and the mounting frame is ≥2.3 mm.

* * * * *